United States Patent [19]

Givot

[11] Patent Number: 4,860,618

[45] Date of Patent: Aug. 29, 1989

[54] HAND HELD WRENCH FOR HELICAL SPRING TYPE WIRE CONNECTORS

[76] Inventor: George Givot, Box 102, Aniak, Ak. 99557

[21] Appl. No.: 83,810

[22] Filed: Aug. 11, 1987

[51] Int. Cl.[4] ..... B25B 13/06

[52] U.S. Cl. ..... 81/121.1; 81/124.4; 81/125.1

[58] Field of Search ..... 81/121.1, 124.4, 489, 81/3.4, 901, 63, 124.2, 119, 125.1, 124.5, 488, 60

[56] References Cited

U.S. PATENT DOCUMENTS

| | | | |
|---|---|---|---|
| 2,565,961 | 8/1951 | Godfrey | 81/63 |
| 2,891,434 | 6/1959 | Lozensky | 81/63 |
| 3,151,512 | 10/1964 | Charczenko | 81/124.2 |
| 3,787,948 | 1/1974 | Runge | 81/121.1 |
| 4,252,036 | 2/1981 | Vanderhoof | 81/119 |
| 4,304,019 | 12/1981 | Sava | 81/488 |
| 4,357,845 | 11/1982 | Cornia | 81/124.2 |

FOREIGN PATENT DOCUMENTS

| | | | |
|---|---|---|---|
| 0966700 | 10/1950 | France | 81/124.4 |

*Primary Examiner*—Frederick R. Schmidt
*Assistant Examiner*—Blynn Shideler
*Attorney, Agent, or Firm*—Michael J. Tavella

[57] ABSTRACT

An improved wire nut wrench is disclosed. The wrench is designed in four configurations. The first is generally cylindrical in shape and sized to fit a normal sized hand. The cylinder has a wire nut receptacle opening in the base. A wire nut is inserted into the receptacle and is secured to the wires. The second configuration has two receptacles, one placed on each end of the cylinder. These receptacles are sized to accommodate different styles of wire connectors. The third and fourth configurations are identical to the first and second except for the addition of a ratchet mechanism installed within the body of the cylinder. Three different types of strap arrangements are also disclosed to allow the tool to be hung from a tool belt when not in use.

12 Claims, 2 Drawing Sheets

HAND HELD WRENCH FOR HELICAL SPRING TYPE WIRE CONNECTORS

BACKGROUND OF THE INVENTION

This invention is related to tools for securing helical spring type wire connectors commonly known as WING NUTS or WIRE NUTS.

In electrical work, wires are typically connected with spring loaded fasteners. These fasteners are small conical devices that often have small protrusions or wings to provide a gripping surface for tightening the connectors. Although these devices are a big improvement over solder and tape splices, and are available in many sizes, they are difficult to place on wires by hand. The size of the connectors are such that they tend to cause hand cramps after many connections have been made. Also, when many wires are connected it is sometimes difficult to obtain sufficient torque on the connectors, creating a poor connection.

To alleviate these difficulties, connector wrenches have been developed to make using the devices easier, and to ensure that all connections are properly torqued. One example of this type of wrench is found in U.S. Pat. No. 3,787,948, which discloses a wrench having an oblong head piece that has an opening sized to fit a typical wing type connector. A handle extends from the opposite end of the headpiece from the connector opening. The handle is ratched to allow the entire headpiece to rotate around the connector, thereby tightening the connector. This device has several problems. First, the handle is offset from the opening, making the device awkward dot use. Further, it is hard to obtain proper leverage to make a tight connection because of this thin handle.

Other devices include a small wrench device that is designed to accomodate two different sized connector. This device is generally shaped like a platened cylinder with connector recepticles placed side-by-side in the base. This device is small and must be held by the fingers, much like the connector itself. This device, therefore, will cause the same cramping with repeated use as do the connectors. Also, its small size makes it difficult to obtain good leverage to make solid connections.

Another device is simply a screwdriver that has a hole drilled in its base that is sized to fit a connector. Although this device has some advantages over the others, is also has the drawback of having a metal blade extending from the opposite end. This produces a potential safety problem if the device is used around live electrical circuits. Also the blade could cause injury when the device is being used. The latter devices are produced by Ideal Industries, Incorporated, Sycamore, Ill.

BRIEF DESCRIPTION OF THE INVENTION

The present invention overcomes all of these difficulties. It consists of a cylinderical housing that has four basic configurations. The first embodiment consists of a cylinder that has an opening placed in one end that is sized to accomodate a typical wire connector. This is the simplest design. The second configuration has an additional opening in the opposite end from the first opening. In the second embodiment, the two openings are designed differently to accomodate two different styles of wire connector. The third and fourth configurations duplicate the first and second embodiments except for the addition of a ratchet, mounted in the center portion of the cylinder to provide for faster operation of the device.

All configurations are fitted with a carry strap that can be used to suspend the tool from a standard tool belt.

The cylindrical housing is sized to accomodate the average hand such that it minimizes the tendency to cramp the hand. It is also designed to allow the user to generate the maximum torque to ensure proper, safe connections.

It is an object of this ivne;ntion to produce a wrench for connecting wires using helical spring type wire connectors.

It is another object of this invention to produce a wrench for use with helical spring type wire connectors that will generate sufficient torque to ensure safe, properly made connections without putting undue strain on a workers hands.

It is yet another object of this invention to produce an improved wrench for use with helical spring type wire connectors that has a ratchet mechanism to allow for faster operation of the device.

It is yet another object of this invention to produce a wrench for use with helical spring type wire connectors that is capable of fastening a large variety of connectors without the need for multiple tools or special adapters or inserts.

It is yet another object of this invention to produce a safe, efficient wrench for use with helical spring type wire connectors that prevents hand cramps commonly developed after repeated application of wire connectors.

DETAILED DESCRIPTION OF THE INVENTION

Figure 1:
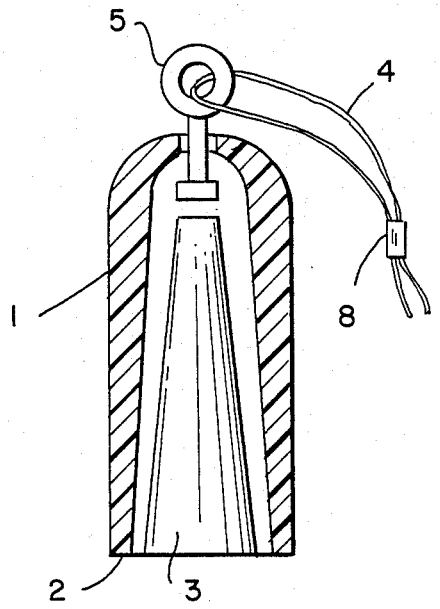
FIG. 1 is a cross sectional view of the first embodiment.
Figure 5:
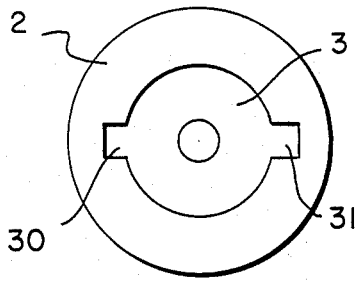
FIG. 5 is a detail view of the receptacle end of the first and third embodiments.

Referring now to the drawings, and more particularly to FIG. 1, the simplest form of the invention is shown. It consists of a cylindrical housing 1, typically made of high strength plastic. to avoid electrical conduction, or some other similar non-conductive material. This embodiment has no moving parts associated with it (other than the strap). The cylinder is longer than it is wide. Typically, it is sized to fit an average hand and is approximately 1.5 to 2.0 inches in diameter. In the bottom end 2 of the device, is a connector receptical 3. This receptical has two slots 30 and 31 (see FIG. 5) which will accept the flanges commonly found on wire connectors (see FIGS. 7 and 8). The connector receptical 3 is tapered to accomodate many different sizes of connectors. The taper is wider toward the bottom 2 of the housing 1.

The device is also fitted with a carry strap 4 which is secured to the device by an eye 5. The eye 5 is secured to the housing as shown and is designed to swivel within the housing 1. The strap 4 is adjustable by means of a slipping 6, which is attached to the strap 4 as shown. The strap 4 can be adjusted by sliding the slip ring 6 along the strap 4 until the desired size loop is found. The strap can be worn around the wrist during use by securing the strap 4 around it. In this manner, the tool can be hung from the wrist while the worker gathers up wires, or gets additional connectors, and tool will be readily available when needed. The swivel feature of the eye 5 allows the tool to remain strapped on the wrist while it is being used to tighten a connector.

Figure 2:
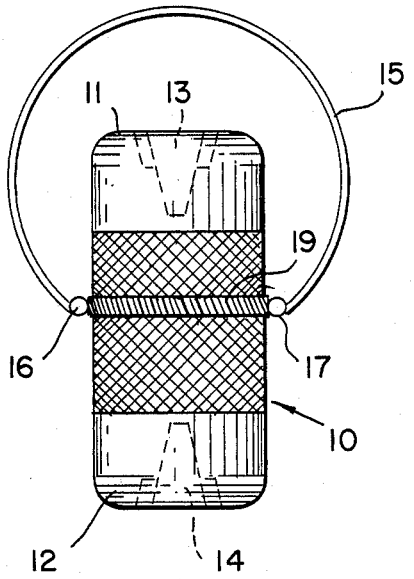
FIG. 2 is a side view of the second embodiment.

The outside of the housing 1 is knurled in a similar manner as shown in FIG. 2 for housing 10, to improve the grip when the device is used.

Referring now to FIG. 2, the second embodiment of the invention consists of a slightly different cylindrical housing 10. The second housing 10 is essentially the same size as the first embodiment. The outer surface of the housing 10 is also knurled. The primary difference between these embodiments is that a connector receptical is formed in each end of the cylindrical housing 10. The first end 11 of the housing is provided with a first receptacle 13. The second end of the housing 12 is provided with a separate receptacle 14. Both recepticles are formed differently than the one receptacle 3 of the first embodiment. The recepticles are designed to accomodate different types of connectors.

Figure 9:
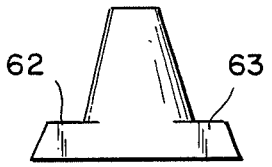
FIG. 9 is a side view of a second type of typical connector.
Figure 8:
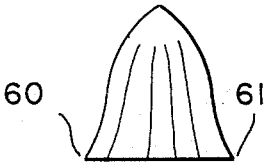
FIG. 8 is a side view of one type of typical connector.

Referring now to FIGS. 8 and 9, two main variations of connector design are shown. FIG. 8 shows a connector that has an overall rounded shape. The connector has two flanges 60 and 61 which are used to assist in the application of the connector. These flanges are rounded. FIG. 9 shows a second type of connector. This type of connector has angled lines and is not curved. The connector also has flanges 62 and 63. These flanges are also angled and look more like wings.

Figure 6:
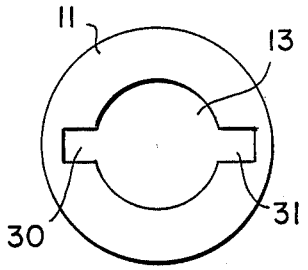
FIG. 6 is a detail view of the first end of the second and fourth embodiments.
Figure 7:
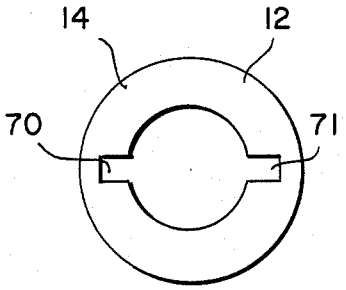
FIG. 7 is a detail view of the second end of the second and fourth embodiments.

Referring now to FIGS. 2, 6 and 7, the connector recepticles 13 and 14 are designed to accomodate these different types of flanges. Receptacle 13 is designed to accommodate the style of connector shown in FIG. 8, and receptacle 14 is designed to accomodate connectors of the style shown in FIG. 9.

As in the case of the first embodiment, the second embodiment is also provided with a strap 15 is attached to the side of the housing at eyelets 16 and 17 as shown. The eyelets 16 and 17 are swivel eyelets of either nylon or metal and are attached to the side of the housing within a groove 19. The groove 19 is designed to allow the eyelets to rotate around the tool as the tool is being used. Since the eyelets 16 and 17 are free to move around the housing, the strap 15 will not bind. The swivel eyelets are designed to allow the strap 15 to be worn on the wrist while the tool is in use, without having the strap 15 bind around the tool or the worker's wrist.

Figure 3:
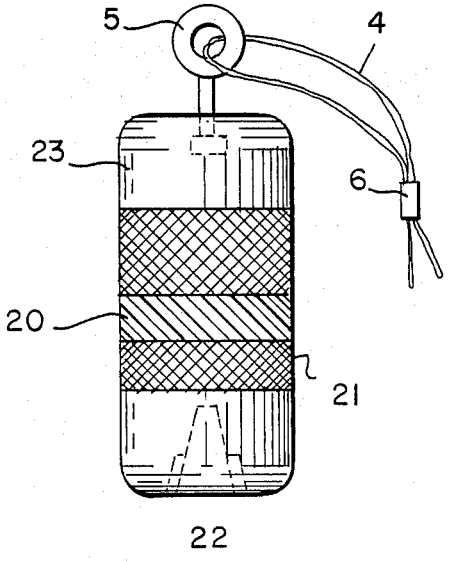
FIG. 3 is a side view of the third embodiment.

Referring now to FIG. 3, the third embodiment is identical to the first embodiment except that this embodiment has a ratchet mechanism 20 installed within to allow faster wrench operation. The ratchet mechanism 20 can be any type commonly found in the art and is designed to fit within the upper and lower portions of the device. In practice, the third embodiment has an upper housing 21, which has a connector receptacle 22 placed therein. The Connector receptacle 22 in this embodiment is constructed in exactly the same manner as the receptacle 3 in the first embodiment, to allow different styles of connector to be placed therein. A lower housing 23 forms the rest of the assembly. The ratchet 20 is placed between the upper housing 21 and the lower housing 23. The housings can be glued, welded or otherwise attached by means known in the art to secure both housings to the ratchet 20 such that the lower housing 23 can be rotated independently from the upper housing 21 in the reverse ratchet direction and that both housings, 21 and 23 can be rotated together in the forward ratchet direction.

Figure 4:
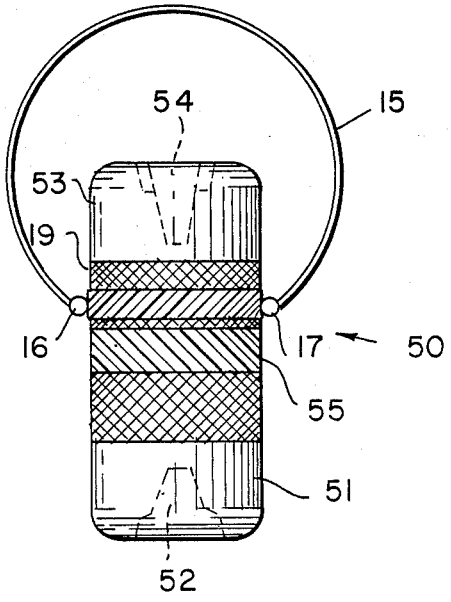
FIG. 4 is a side view of the fourth embodiment.

Referring now to FIG. 4, the fourth embodiment of the device is shown. This embodiment is the preferred embodiment. This embodiment is essentially the same as the second embodiment, with the addition of a ratchet means similar to that discussed above in the third embodiment. The device 50 is comprised of an upper housing 51, having a connector receptacle 52 therein as shown. A lower housing unit 53 is also provided. It also has a connector receptacle 54 placed therein. Both the upper housing and the lower housing are attached to a ratchet mechanism 55 in the same manner as described above for the third embodiment. Unlike the case of the third embodiment, The ratchet mechanism 55 must be reversible so that when receptacle 52 is used, the lower housing 53 will rotate in the reverse ratchet direction and be locked in the forward direction and when receptacle 54 is used, the upper housing 51 will rotate in the reverse ratchet direction and will lock in the forward ratchet direction, with respect to the receptacle 54.

In the fourth embodiment, connector receptacle 51 is designed to accomodate a connector of the type shown in FIG. 8, and receptacle 54 is designed to accomodate connectors of the type shown in FIG. 9.

Figure 10:
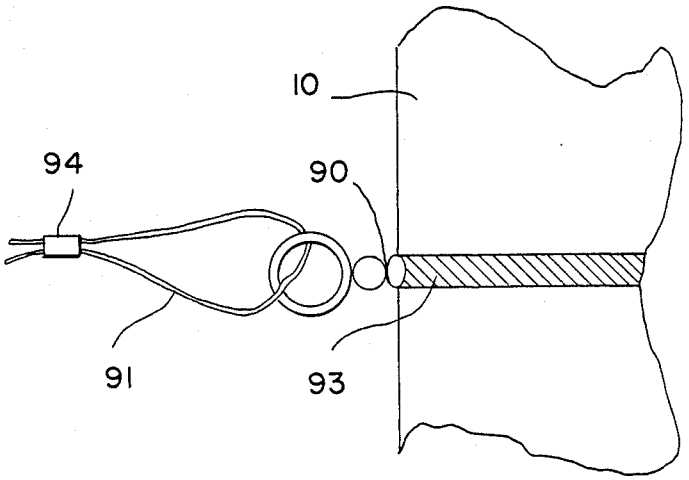
FIG. 10 is a detail view of the second type of strap used in embodiments two and four.

A loop or strap can also be used with the third and fourth embodiments as shown. As in the case of the first embodiment, the third embodiment having a single receptacle has a strap that is connected to a swivel eye 5 placed in the top of the housing as shown in the Figure. The loop 4 is formed of leather or like material and is secured with a locking connector 6 as shown. The locking connector 6 is slidably attached to the loop 4, allowing the size of the loop to be adjusted. As in the case of embodiment two, embodiment four has a strap 15 is attached to the side of the housing, above or below the ratchet mechanism at eyelets 16 and 17 as shown. As in the first case, the eyelets 16 and 17 are swivel eyelets of either nylon or metal and are attached to the side of the housing within a groove 19. The groove 19 is designed to allow the eyelets to rotate around the tool as the tool is being used. Since the eyelets 16 and 17 are free to move around the housing, the strap 15 will not bind. The swivel eyelets are designed to allow the strap 15 to be worn on the wrist while the tool is in use, without having the strap 15 bend around the tool or the worker's wrist. In the case of embodiments two and four, an alternative strap means can be used. Referring now to FIG. 10, a single swivel eye 90 can be used to connect an adjustable ring 91 as shown. The swivel eye 90 is attached to the side of the housing with a groove 93. The groove 93 is designed to allow the eyelet to rotate around the tool as the tool is being used. Since the eyelet 90 is free to move around the housing, the ring 91 will not bind. In the case of the fourth embodiment, the swivel eye 90 must be mounted either above or below the ratchet 55. The adjustable ring 91 is adjusted with a connector clip 92, and can be adjusted in the same manner as the strap described above for the first and third embodiments. In this case, however, the ring is designed to fit around a worker's finger.

To use embodiments one or two, a connector is placed in the appropriate receptacle. The wires to be connected are stripped of the insulation in accordance with the connector manufactures recommendations. The wires are then bunched together and the device, with the connector installed, is placed over the bared ends of the wires. The device is then rotated in a clockwise direction until the connector is fully set and properly torqued. The device is then pulled straight back from the connector until the connector has completely pulled free.

The operation of the third and fourth embodiments is identical to that described above, except that the ratchet mechanism increases the installation speed.

It is intended that the present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to modification by skilled persons within the scope of the invention without departing from the concept thereof.

I claim:

1. A wrench for twisting wire nuts, having flanges, onto the ends of wires comprising:

A. a housing having a generally cylinderical shape, and having a top end and a bottom end, said top end being generally curved and said bottom end being generally flat, said housing also having a length greater than its width, said cylinder also having a tapered receptacle extending inwardly from the bottom end into the housing, said receptacle being generally cylindrical in shape and having two rectangular extension portions, being oppositely disposed, extending radially therefrom within the plane of said bottom end, said rectangular end portions being disposed such that the flange portions of said wire nuts are aligned with said rectangular end portions when said wire nut is placed within said receptacle, further comprising rachet means fixedly disposed within said housing, thereby dividing said housing into a lower housing, having the receptacle therein, and an upper housing, such that the lower housing can be rotated independently from the upper housing in the reverse ratchet direction and that both housings can be rotated together in a forward ratchet direction.

2. The device of claim 1 further comprising: strap means flexibly attached to said top end of said housing.

3. The device of claim 2 wherein said strap means comprise: a swivel eye, fixedly attached to the top end of said housing; and a loop of material having connection means thereon such that said material is restrained on said device and such that the size of the loop may be adjusted.

4. The device of claim 1 further comprising knurling placed on the outer surface of said housing to assist in gripping the device.

5. A wrench for twisting a first type of wire nuts having rectangular flanges and a second type of wire nuts, having flanges that are rounded, onto the ends of wires comprising:

A. a housing having a generally cylindrical shape, and having a top end and a bottom end, said top end and said bottom end being generally flat, said housing also having a length greater than its width, said cylinder also having a first tapered receptacle extending inwardly from the bottom end into the housing, said first receptacle being generally cylindrical in shape and having two rectangular extension portions, being oppositely disposed, extending radially therefrom within the plane of said bottom end, said rectangular end portions being disposed such that the flange portions of said first type wire nuts having rectangularly shaped flanges portions are aligned with said rectangular end portions when said first type wire nut is placed within said first receptacle; said top end having a second tapered receptacle extending inwardly from the top end into the housing, said second receptacle also being generally cylindrical in shape, and having two semicircular extension portions, being oppositely disposed, extending radially therefrom within the plane of said top end, said semicircular end portions being disposed such that the flange portions of said second type wire nuts having rounded flanged are aligned with said semicircular end portions when said second type wire nut is placed within said second receptacle.

6. The device of claim 5 further comprising: strap means, flexibly attached to said housing.

7. The device of claim 6 wherein said strap means comprise: two swivel eyelets fixedly and rotatably attached to said housing, and being oppositely displaced thereon; and a loop of material having connection means thereon to attach said loop to said swivel eyelets.

8. The device of claim 5 further comprising knurling placed on the outer surface of said housing to assist in gripping the device.

9. The device of claim 5 further comprising ratchet means fixedly disposed within said housing, thereby dividing said housing into a lower housing having said first receptacle and an upper housing have said second receptacle, said ratchet means being reversible such that when the first receptacle is sued, the upper housing rotates in the reverse ratchet direction and is locked in the forward direction and when said second receptacle is used, the lower housing rotates in the reverse ratchet direction and will lock in the forward ratchet direction, with respect to the second receptacle.

10. The device of claim 9 further comprising strap weans flexibly connected to said housing.

11. The device of claim 10 wherein the strap means comprise a single swivel eyelet rotatably attached to the side of said housing; and adjustable ring means rotatably attached to said swivel eyelets.

12. The device of claim 10 wherein said strap means comprise two swivel eyelets fixedly and rotatably attached to said housing, and being oppositely displaced thereon; and a loop of material having connection means thereon to attach said loop to said swivel eyelets.

* * * * *